US008337282B2

(12) United States Patent
Park et al.

(10) Patent No.: US 8,337,282 B2
(45) Date of Patent: Dec. 25, 2012

(54) POLISHING PAD

(75) Inventors: Jaehong Park, Kyoto (JP); Shinichi Matsumura, Kyoto (JP); Kouichi Yoshida, Kyoto (JP); Yoshitane Shigeta, Kyoto (JP); Masaharu Kinoshita, Kyoto (JP)

(73) Assignee: Nitta Haas Incorporated, Osaka (JP)

( * ) Notice: Subject to any disclaimer, the term of this patent is extended or adjusted under 35 U.S.C. 154(b) by 737 days.

(21) Appl. No.: 12/440,184

(22) PCT Filed: Aug. 31, 2007

(86) PCT No.: PCT/JP2007/066980
§ 371 (c)(1),
(2), (4) Date: Jun. 17, 2009

(87) PCT Pub. No.: WO2008/029725
PCT Pub. Date: Mar. 13, 2008

(65) Prior Publication Data

US 2010/0009612 A1 Jan. 14, 2010

(30) Foreign Application Priority Data

Sep. 6, 2006 (JP) ..... P2006-241265

(51) Int. Cl.
*B24D 11/00* (2006.01)

(52) U.S. Cl. ..... 451/527; 451/533; 451/550

(58) Field of Classification Search ..... 451/533, 451/526, 527, 550
See application file for complete search history.

(56) References Cited

U.S. PATENT DOCUMENTS

| | | | | |
|---|---|---|---|---|
| 5,489,233 | A * | 2/1996 | Cook et al. | 451/41 |
| 5,645,469 | A * | 7/1997 | Burke et al. | 451/41 |
| 5,702,563 | A * | 12/1997 | Salugsugan et al. | 438/692 |
| 5,888,121 | A * | 3/1999 | Kirchner et al. | 451/41 |
| 6,692,338 | B1 * | 2/2004 | Kirchner | 451/41 |
| 7,121,938 | B2 * | 10/2006 | Suzuki | 451/527 |
| 7,270,595 | B2 * | 9/2007 | Elmufdi et al. | 451/36 |
| 2002/0108861 | A1 | 8/2002 | Emesh et al. | |
| 2004/0072516 | A1 * | 4/2004 | Osterheld et al. | 451/285 |
| 2005/0202761 | A1 * | 9/2005 | Rodriguez et al. | 451/56 |
| 2007/0049168 | A1 | 3/2007 | Fujita | |
| 2007/0077862 | A1 * | 4/2007 | Swedek et al. | 451/5 |

FOREIGN PATENT DOCUMENTS

| | | |
|---|---|---|
| JP | 2000-334655 | 12/2000 |
| JP | 2002-075932 | 3/2002 |
| JP | 2005-294661 | 10/2005 |
| JP | 2005-329534 | 12/2005 |
| JP | 2006-075914 | 3/2006 |
| JP | 2006-142474 | 6/2006 |
| JP | 2007-067110 | 3/2007 |

OTHER PUBLICATIONS

Japanese Office Action issued in Japanese Patent Application No. 2009-099768 dated May 9, 2012.

* cited by examiner

*Primary Examiner* — Timothy V Eley
(74) *Attorney, Agent, or Firm* — McDermott Will & Emery LLP

(57) ABSTRACT

The present invention provides a polishing pad which can improve qualities of an object to be polished by improving the flatness of the object. A polishing surface 1*a* of a polishing pad 1 is subjected to a mechanical process, such as buffing, so that the flatness of the surface is improved, and corrugations on the polishing surface have a cycle of 5 mm-200 mm and a largest amplitude of 40 μm or less. As a result, the flatness of the object polished by the polishing pad 1, such as a silicon wafer, is improved.

9 Claims, 5 Drawing Sheets

POLISHING PAD

RELATED APPLICATIONS

This application is the U.S. National Phase under 35 U.S.C. §371 of International Application No. PCT/JP2007/066980, filed on Aug. 31, 2007, which in turn claims the benefit of Japanese Application No. 2006-241265, filed on Sep. 6, 2006, the disclosures of which Applications are incorporated by reference herein.

FIELD OF THE INVENTION

The present invention relates to a polishing pad which is used for polishing an object to be polished, such as a silicon wafer, in a manufacturing process of a semiconductor device or the like.

BACKGROUND OF THE INVENTION

As a process for flattening a semiconductor wafer such as a silicon wafer is conventionally adopted a chemical mechanical polishing (CMP) process (for example, see the Patent Document 1).

According to the CMP process, a polishing pad is retained on a machine platen and an object to be polished, such as a silicon wafer, is retained on a polishing head, and the polishing pad and the object to be polished, which are being pressurized, are slid over each other while slurry is continuously supplied thereto so that the object is polished.

PATENT DOCUMENT 1: 2000-334655 of the Japanese Patent Applications Laid-Open

DISCLOSURE OF THE INVENTION

Problem to be Solved by the Invention

As a semiconductor device is increasingly highly integrated, demand for a higher level of flattening of an object to be polished increasingly grows. Therefore, various approaches have been so far made to satisfy such demand. For example, grooves are formed on the surface of a polishing pad so that slurry can be homogeneously supplied into between the polishing pad and the object to be polished or an average surface roughness Ra of the surface of a polishing pad is improved. These approaches, however, are not as effective as expected. When a large wafer is polished, in particular, it is not easy to achieve a higher level of flatness overall.

Further, when a polishing pad is used, it is conventionally necessary, as a means of improving poshing performance, to roughen the surface of the polishing pad in a dressing process using a disk containing diamond abrasive grains, such process being called break-in (startup) in general, in an initial stage in which the polishing pad is attached to a polishing device and the polishing device is then activated. In order to improve the productivity of semiconductor wafers, it is desirable to reduce an amount of time required for break-in.

Therefore, a main object of the present invention is to improve qualities of an object to be polished by improving the flatness of the object, and to reduce break-in time.

Means for Solving the Problem

The inventors of the present invention tackled various challenges in order to achieve the foregoing object, and found out that the improvement of waviness on a surface of a polishing pad effectively led to the improvement of the flatness of an object to be polished and completed the present invention.

The waviness denotes unevenness whose dimension is in the range of 20 mm-200 mm and whose amplitude is in the range of 10 μm-200 μm.

A polishing pad according to the present invention is a polishing pad used for polishing an object to be polished, comprising a polishing surface pressed onto the object to be polished, wherein waviness on the polishing surface has a dimension in the range of 5 mm-200 mm and a largest amplitude of 40 μm or less.

According to the present invention, since the waviness on the polishing surface pressed onto the object to be polished is reduced, influences of the waviness on the polishing surface exerted on the object to be polished is lessened. As a result, the flatness of the object to be polished can be improved.

A polishing pad according to the present invention is a polishing pad used for polishing an object to be polished, comprising a polishing surface pressed onto the object to be polished, wherein a zeta potential of the polishing surface measured with a use of a neutral solution is equal to or above −50 mV and less than 0 mV.

According to the present invention, the minus zeta potential of the polishing surface of the polishing pad is equal to or above −50 mV and less than 0 mV, which is closer to zero than a zeta potential of a polishing surface of a conventional polishing pad. Therefore, repulsion against abrasive particles of slurry is controlled, and a fit between the slurry and the polishing surface of the polishing pad becomes better. As a result, the break-in time can be reduced, and the productivity can be improved.

In a preferred embodiment of the present invention, an average surface roughness Ra of the polishing surface may be equal to or above 1 μm and equal to or below 5 μm.

In another preferred embodiment of the present invention, an underground layer may be provided below a polishing layer comprising the polishing surface so that suitable cushioning characteristics can be provided by the underground layer.

Effect of the Invention

According to the present invention, since the waviness on the polishing surface to be pressed onto the object to be polished is reduced, the flatness of the object to be polished can be improved.

Further, the minus zeta potential of the polishing surface of the polishing pad is closer to zero comparing to the zeta potential of the polishing surface of the conventional polishing pad. Accordingly, the repulsion against the minus abrasive particles of the slurry is controlled, and a fit between the slurry and the polishing surface of the polishing pad becomes better. As a result, the break-in time can be reduced, and the productivity can be improved.

DESCRIPTION OF REFERENCE SYMBOLS

Figure 1:
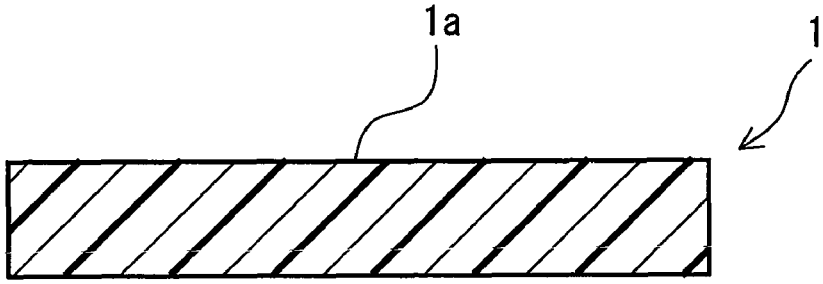
FIG. 1 is a schematic sectional view of a polishing pad.

| | |
|---|---|
| 1 | polishing pad |
| 2 | polishing surface |

Preferred Embodiments for Carrying Out the Invention

Hereinafter, preferred embodiments of the present invention are described in detail referring to the drawings.

FIG. 1 is a sectional view of a polishing pad according to a preferred embodiment of the present invention.

A polishing pad 1 according to the present preferred embodiment can be obtained when foamable resin, such as polyurethane, is foamed and then cured. The polishing pad may not necessarily have foamable structure and may have a non-foamable structure. Further, a non-woven fabric pad may also be used.

In the present preferred embodiment, in order to improve the flatness of an object to be polished such as a silicon wafer, the entire area of a polishing surface 1*a* to be pressed onto the object to be polished is buffed so that waviness on the polishing surface 1*a* is lessened.

When the polishing surface 1*a* is thus buffed, a largest amplitude of the waviness in a dimension of 5 mm-200 mm on the polishing surface 1*a* is reduced to be 40 μm or less. The largest amplitude is preferably as small as possible.

The method of reducing the waviness on the polishing surface is not limited to a buffing process and the polishing surface may be milled or pressed.

Hereinafter, preferred embodiments of the present invention are described.

Embodiment 1

In a embodiment 1 of the present invention and a conventional example, an MH-type polishing pad manufactured by Nitta Haas Incorporated, which is a foamable urethane pad having relatively large foaming diameters suitable for polishing silicon, was used.

Figure 2:
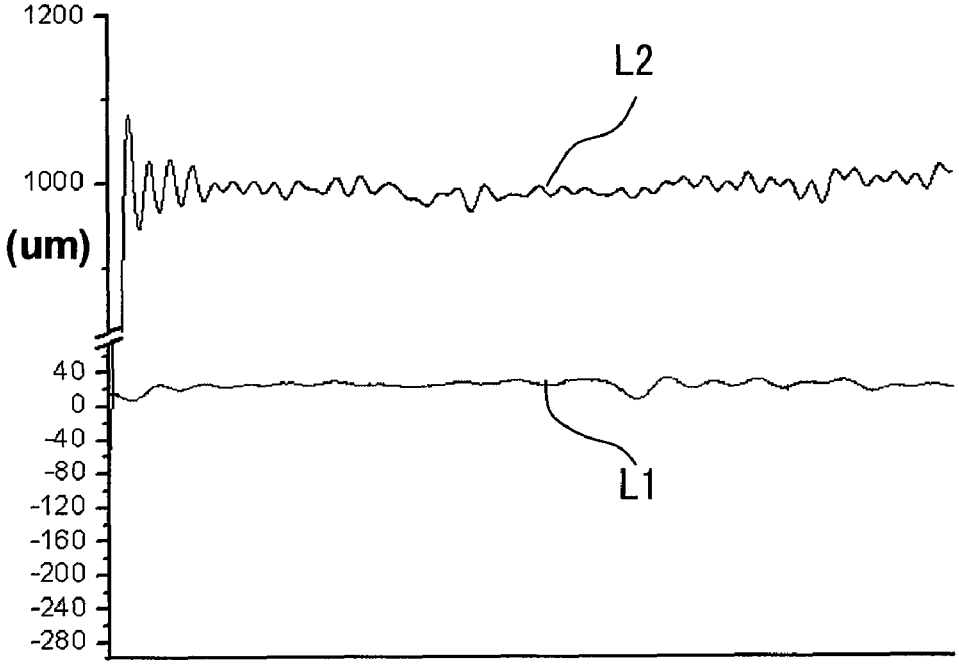
FIG. 2 is a drawing illustrating a measurement result of waviness on a polishing surface of a polishing pad according to a conventional example 1 and a measurement result of waviness on a polishing surface of a polishing pad according to a embodiment 1 of the present invention

FIG. 2 is a drawing illustrating a measurement result of waviness a polishing surface of a polishing pad according to the embodiment 1 which was buffed by sand paper of count #240, and a measurement result of waviness on a polishing surface of a polishing pad according to the conventional example 1 which was not buffed.

In the drawing, a horizontal axis denotes positions on the polishing surface of the polishing pad, and Line L1 denotes the embodiment 1 and Line L2 denotes the conventional example 1. The waviness on the polishing surface was measured by a measurement device HSS-1700 manufactured by Hitachi Zosen Corporation.

In the case of the polishing pad according to the conventional example 1, the surface of which was not buffed, a sharp rise is shown as illustrated in Line 2, the polishing surface has a lot of waviness, and the largest amplitude thereof exceeds 40 μm. In contrast, the polishing pad according to the embodiment 1 shows a modest rise as illustrated in Line 1, and it is learnt that the polishing surface has less waviness, and the largest amplitude is reduced to be 40 μm or less.

Each of the polishing pads according to the embodiment 1 and the conventional example 1 was used to polish both surfaces of a silicon wafer of 300 mm under the following conditions, and the flatness of the silicon wafer and a polishing rate were evaluated.

The number of rotations of an upper machine platen was 20 rpm, the number of rotations of a lower machine platen was 15 rpm, an applied pressure was 100/cm$^2$, silica slurry at 25° C. was used, and a volumetric flow of the slurry was 2.5 L/min.

Table 1 shows the GBIR (Global Back Ideal Range), SFQR (Site Front Least Squares Range), roll off and polishing rate of the polished silicon wafer. In the table, respective average values obtained in a polishing test for five silicon wafers are shown.

TABLE 1

| | embodiment 1 | conventional example 1 |
|---|---|---|
| GBIR | 0.207 | 0.349 |
| SFQR | 0.100 | 0.152 |
| Roll-off | 0.100 | 0.23 |
| Removal rate | 0.46 | 0.39 |

As shown in Table 1, the flatness represented by the GBIR and SFQR of the silicon wafers polished by the polishing pad according to the embodiment 1 was improved in comparison to that achieved by the polishing pad according to the conventional example 1, and the roll off and the polishing rate were also improved.

Figure 3:
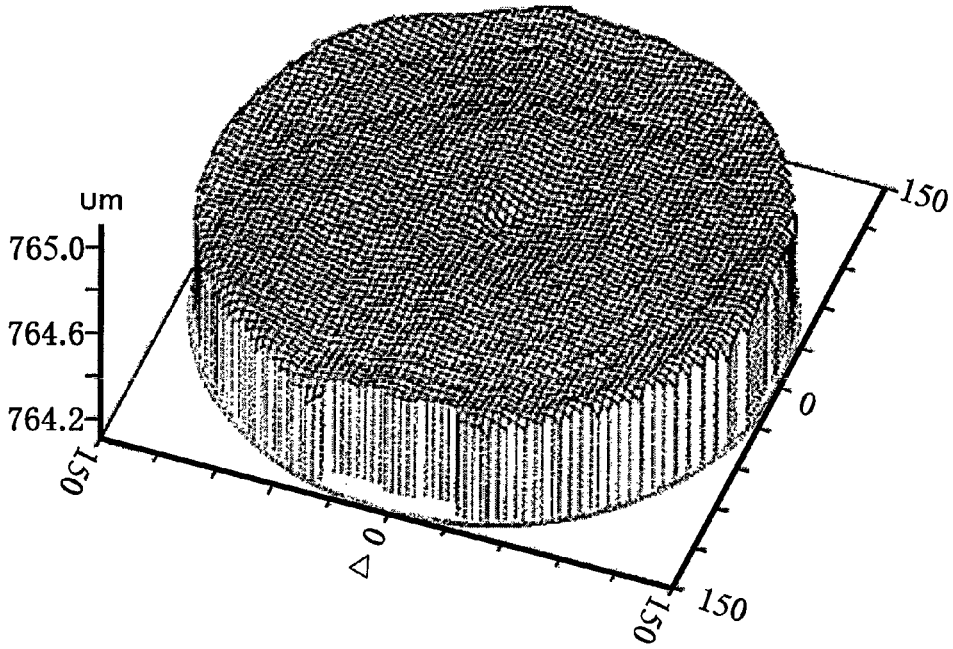
FIG. 3 is a drawing illustrating a shape of a silicon wafer polished by the polishing pad according to the embodiment 1.
Figure 4:
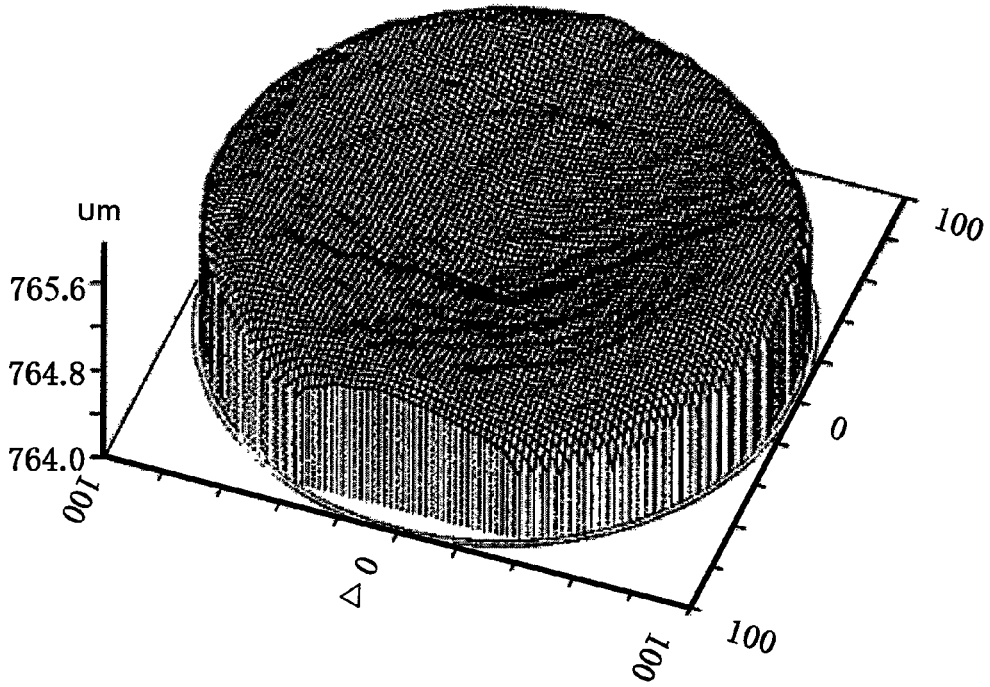
FIG. 4 is a drawing illustrating a shape of a silicon wafer polished by the polishing pad according to the conventional example 1.

FIGS. 3 and 4 respectively illustrate a shape of the silicon wafer polished by the polishing pads according to the embodiment 1 and a shape of the silicon wafer polished by the polishing pads according to the conventional example 1.

The silicon wafers were measured by a laser measuring device, which was NANOMETRO 200TT manufactured by KURODA Precision Industries Ltd.

It can be confirmed that a central portion, rather than a peripheral portion, of the silicon wafer was polished by the polishing pad according to the conventional example 1 as illustrated in FIG. 4, while the entire surface of the silicon wafer was homogeneously polished by the polishing pad according to the embodiment 1 as illustrated in FIG. 3.

As described, when the polishing pad according to the embodiment 1 capable of reducing the waviness on the polishing surface is used, the flatness of the silicon wafer can be improved, and the roll off and the polishing rate can also be improved.

Figure 5:
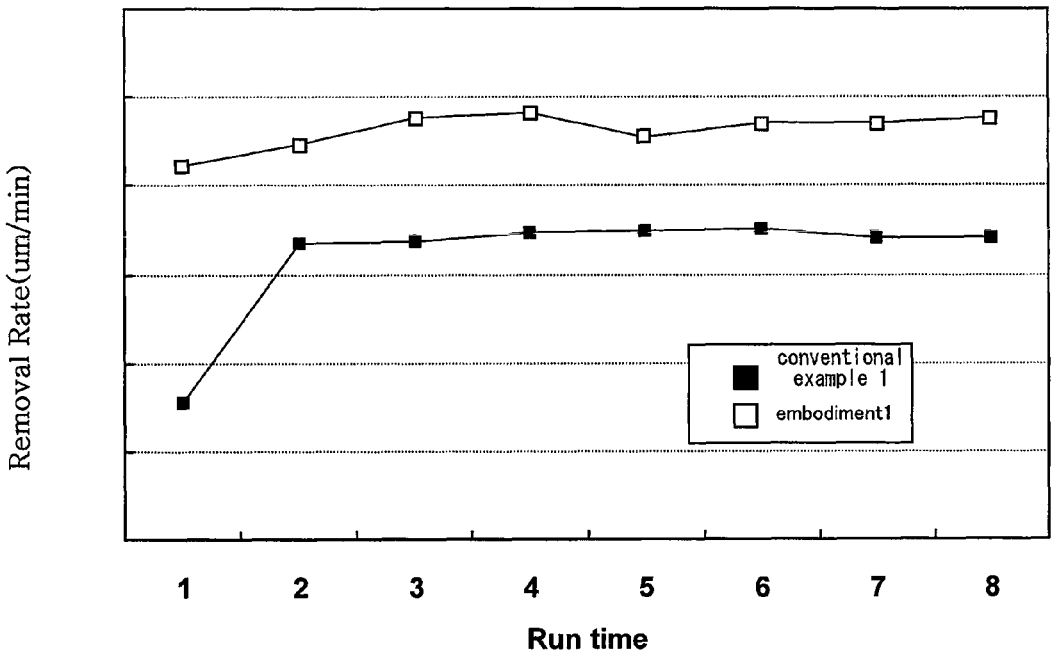
FIG. 5 is an illustration of the variation of polishing rates versus the number of times a polishing process is repeated in the embodiment 1 and the conventional example 1.

FIG. 5 is an illustration of the variation of the polishing rates versus the number of times a polishing process is repeated in the embodiment 1 and the conventional example 1.

The polishing rate of the polishing pad according to the embodiment 1 was kept high with stability from the first round of the polishing process, while the polishing rate of the polishing pad according to the conventional example 1 was stable from the second round of the polishing process.

As is learnt from FIG. 5, an amount of time necessary for the polishing rate to be increased and then leveled off, which is generally called break-in time, can be reduced, and the polishing rate can be improved in the polishing pad according to the embodiment 1 in comparison to the polishing pad according to the conventional example 1.

Figure 6:
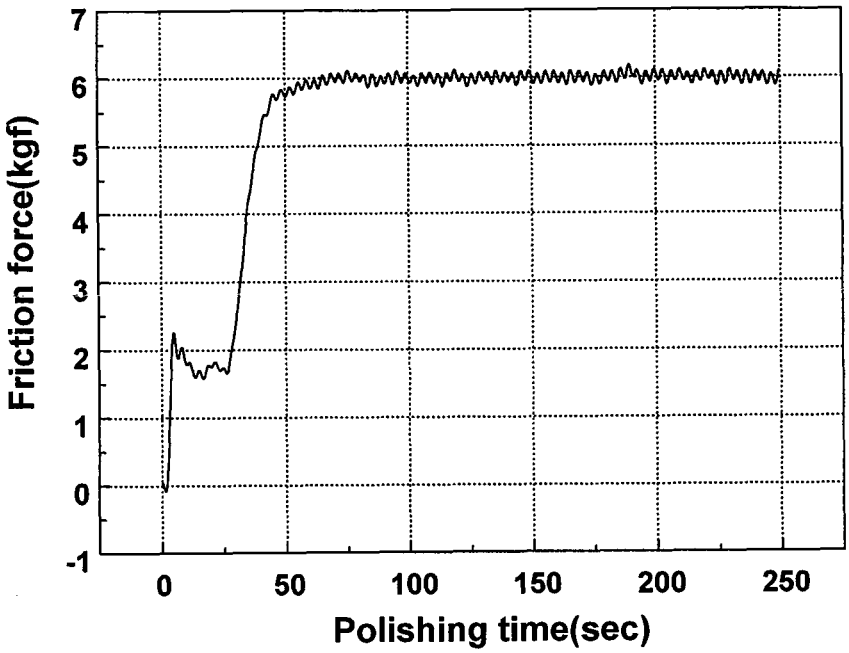
FIG. 6 is an illustration of a relationship between a polishing time and frictional force in the polishing process in which the polishing pad according to the embodiment 1 is used.
Figure 7:
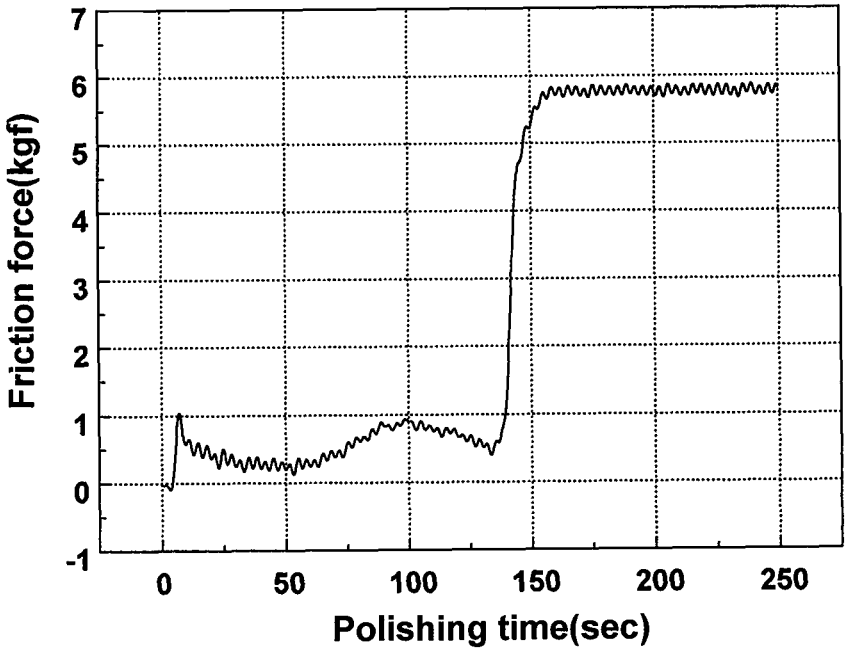
FIG. 7 is an illustration of a relationship between a polishing time and frictional force in the polishing process in which the polishing pad according to the conventional example 1 is used.

FIGS. 6 and 7 respectively illustrate the variation of frictional force relative to a polishing time in the polishing pad according to the embodiment 1 and the variation of the frictional force relative to the polishing time in the polishing pad according to the conventional example 1.

It is necessary for the frictional force to be constant in order to obtain a constant polishing rate. It takes 60 seconds for the constant frictional force to be obtained in the polishing pad according to the embodiment 1, while 150 seconds are necessary in the polishing pad according to the conventional example 1. It can be learnt therefore that the startup time of the polishing process in the polishing pad according to the embodiment 1 is shorter than that in the polishing pad according to the conventional example 1.

Table 2 is measurement results showing values of an average surface roughness Ra of the polishing surfaces of the polishing pads according to the embodiment 1 and the conventional example 1 measured by a real-time scan laser microscope 1LM21D manufactured by Lazertec Co., Ltd. Table 2 shows measurement results obtained from five points in the region of 45 μm×45 μm, and respective average values thereof.

TABLE 2

| average surface roughness Ra (um) | embodiment 1 | conventional example 1 |
|---|---|---|
| sample 1 | 2.87 | 1.79 |
| sample 2 | 2.94 | 1.68 |
| sample 3 | 1.86 | 1.49 |
| sample 4 | 2.42 | 1.50 |
| sample 5 | 2.44 | 1.92 |
| Ave. | 2.51 | 1.68 |

As illustrated in Table 2, the average surface roughness Ra of the polishing surface according to the embodiment 1 which was buffed is larger than that of the conventional example 1. Therefore, the break-in time necessary for the polishing rate to be increased and then leveled off can be reduced in comparison to the conventional example 1 as described earlier.

Embodiment 2

An MH-type polishing pad was used in the embodiment 1 and the conventional example 1. In a embodiment 2 (2-1 and 2-2) and a conventional example 2, an IC-type polishing pad, which is a foamable urethane pad having relatively small foaming diameters manufactured by Nitta Haas Incorporated, was used.

For the embodiment 2, a embodiment 2=1 in which a polishing surface of the IC-type polishing pad was buffed by sand paper of count #100 and a embodiment 2-2 in which the polishing surface was buffed by sand paper of count #240 finer than #100 were prepared, and they are compared to the conventional example 2 in which the polishing surface was not buffed.

In a manner similar to the foregoing embodiment, it was confirmed that the waviness on the polishing surfaces of the polishing pads according to the embodiments 2-1 and 2-2 was less, and the largest amplitudes were also reduced to be 40 μm or less in comparison to the polishing pad according to the conventional example 2, according to measurement results obtained by the measurement device HSS-1700 manufactured by Hitachi Zosen Corporation.

Then, values of the average surface roughness Ra of the polishing surfaces of the polishing pads according to the embodiments 2-1 and 2-2 and the conventional example 2 were measured by the real-time scan laser microscope 1LM21D manufactured by Lazertec Co., Ltd.

Table 3 shows results of the measurement. In Table 3, the measurement results obtained from five points in the region of 18 μm×18 μm and respective average values thereof are shown.

TABLE 3

| average surface roughness Ra (um) | embodiment 2-1 | embodiment 2-2 | conventional example 2 |
|---|---|---|---|
| sample 1 | 1.75 | 1.25 | 0.45 |
| sample 2 | 2.62 | 1.64 | 0.53 |
| sample 3 | 2.70 | 0.99 | 0.63 |
| sample 4 | 1.77 | 1.81 | 0.67 |
| sample 5 | 1.75 | 1.10 | 0.63 |
| Ave. | 2.12 | 1.36 | 0.58 |

As illustrated in Table 3, the average surface roughness Ra is larger on the polishing surfaces, which were buffed, according to the embodiments 2-1 and 2-2 in comparison to the polishing surface according to the conventional example 2. Therefore, the reduction of the break-in time necessary for the polishing rate to be increased and then leveled off can be expected.

In order to reduce the break-in time, the average surface roughness Ra of the polishing surface is preferably equal to or above 1 μm, and more preferably 1 μm-5 μm. The average surface roughness more than 5 μm, which may result in the generation of scratches, is not suitable.

Next, zeta potentials of the polishing surfaces of the polishing pads according to the embodiments 2-1 and 2-2 and the conventional example 2, and the zeta potential of the polishing surface of the polishing pad according to the conventional example 2 subjected to break-in were measured by a zeta potential/particle diameter measuring system ELS-Z2 manufactured by OTSUKA ELECTRONICS CO., LTD. according to the laser Doppler method (dynamic/cataphoretic light diffusion method) in which 10 mM of a neutral NaCl solution was used.

Table 4 shows results of the measurement.

TABLE 4

| zeta potential (mV) | embodiment 2-1 | embodiment 2-2 | conventional example 2 | conventional example 2 subjected to break-in |
|---|---|---|---|---|
| sample 1 | −9.16 | −10.57 | −130.75 | −32.59 |
| sample 2 | −10.32 | −13.26 | −127.37 | −32.25 |

TABLE 4-continued

| zeta potential (mV) | embodiment 2-1 | embodiment 2-2 | conventional example 2 | conventional example 2 subjected to break-in |
|---|---|---|---|---|
| sample 3 | −8.05 | −13.30 | −141.36 | −33.83 |
| Ave. | −9.18 | −12.38 | −133.16 | −32.89 |

As shown in Table 4, average values of the zeta potentials of the polishing surfaces of the polishing pads according to the embodiments 2-1 and 2-2 were −9.18 mV, and −12.38 mV, respectively, while an average value of the zeta potentials of the polishing surface of the polishing pad according to the conventional example 2 was −133.16 mV. Thus, the values obtained from the embodiments 2-1 and 2-2 were closer to 0 mV comparing to the conventional example 2.

As described, the minus zeta potentials of the polishing surfaces of the polishing pads according to the embodiments 2-1 and 2-2 were closer to 0 mV in comparison to the zeta potential of the polishing surface in the conventional example 2. Therefore, the repulsion against the minus abrasive particles of the slurry is controlled, and a fit between the slurry and the polishing surface of the polishing pad becomes better. As a result, the reduction in the break-in time can be expected.

The values obtained from the embodiments 2-1 and 2-2 were closer to zero than −32.89 mV which was the zeta potential average value of the polishing surface of the polishing pad according to the conventional example 2 subjected to break-in. This demonstrates that it is unnecessary in the embodiments 2-1 and 2-2 to perform such break-in as is required in the conventional technology.

In order to reduce the break-in time, the zeta potential of the polishing surface of the polishing pad is preferably equal to or above −50 mV and less than 0 mV.

Next, a silicon wafer with an 8-inch TEOS film attached thereto was polished by the polishing pads according to the embodiment 2-1 and the conventional example 2 and the polishing pad according to the conventional example 2 subjected to break-in under the following conditions, and the polishing rates thereby obtained were evaluated.

The number of rotations of the upper machine platen was 60 rpm, the number of rotations of the lower machine platen was 41 rpm, the applied pressure was 48 kPa, slurry ILD3225 manufactured by Nitta Haas Incorporated was used, and the volumetric flow of the slurry was 100 mL/min. The silicon wafer was polished for 60 seconds, and the 60-second polishing was repeatedly implemented with a 30-second dressing process interposed therebetween.

Figure 8:
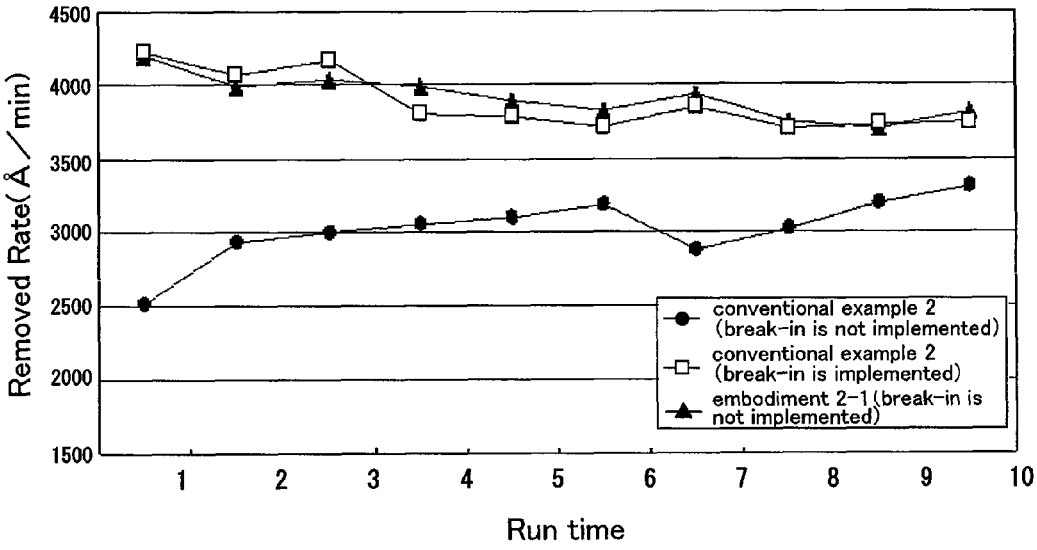
FIG. 8 is an illustration of the variation of polishing rates in the case where a polishing pad according to an embodiment 2-1 of the present invention, a polishing pad according to a conventional example 2, and a polishing pad according to the conventional example 2 after break-in are used.

FIG. 8*s* shows a result of the polishing process.

In the polishing pad according to the embodiment 2-1 shown by ▲, the polishing rate is higher and leveled off sooner in comparison to the polishing pad according to the conventional example 2 shown by ●. Further, the polishing pad according to the embodiment 2-1 was substantially the same as the polishing pad according to the conventional example 2 subjected to break-in shown by □ in terms of a polishing rate and stability.

In other words, the embodiment 2-1 in which break-in was omitted demonstrates the characteristics similar to those of the conventional example 2 subjected to break-in. Therefore, it can be learnt that such break-in as is required in the conventional example 2 is unnecessary for the polishing pad according to the embodiment 2-1.

The flatness of the silicon wafers which were polished by the polishing pads according to the embodiments 2-1 and 2-2 and the conventional example 2 was evaluated in a manner similar to the embodiment 1. As a result, the silicon wafers polished by the polishing pads according to the embodiments 2-1 and 2-2 with no break-in showed the GBIR and SFQR representing the flatness which were equal to or better than those of the silicon wafer polished by the polishing pad according to the conventional example 2 subjected to break-in.

Figure 9:
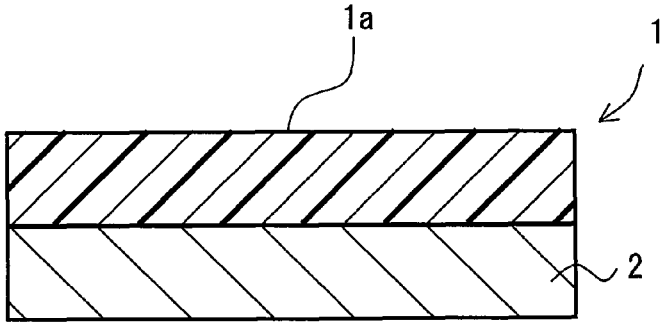
FIG. 9 is a schematic sectional view of a polishing pad according to another preferred embodiment of the present invention.

In the preferred embodiments described so far, the polishing pad has a single-layer structure; however, may have a multilayer structure comprising a ground layer 2, which is made up of a non-woven cloth impregnated with urethane or soft foam, as a lower layer as illustrated in FIG. 9.

INDUSTRIAL APPLICABILITY

The present invention is useful when a semiconductor wafer, such as a silicon wafer, is polished.

What is claimed is:

1. A polishing pad for polishing an object to be polished, the polishing pad comprising a polishing surface to be pressed onto the object to be polished, wherein:

the polishing surface has waviness having dimensions in a range of 5 mm-200 mm along the polishing surface, and a largest amplitude of the waviness is 40 μm or less.

2. A polishing pad for polishing an object to be polished, the polishing pad comprising a polishing surface to be pressed onto the object to be polished, wherein a zeta potential of the polishing surface, before a break-in process for the polishing pad, measured with the use of a neutral solution is equal to or above −50 mV and less than 0 mV.

3. The polishing pad as claimed in claim 1, wherein a zeta potential of the polishing surface measured with the use of a neutral solution is equal to or above −50 mV and less than 0 mV.

4. The polishing pad as claimed in claim 3, wherein an underground layer is provided below a polishing layer comprising the polishing surface.

5. The polishing pad as claimed in any of claims 1 through 3, wherein an average surface roughness Ra of the polishing surface is equal to or above 1 μm and equal to or below 5 μm.

6. The polishing pad as claimed in claim 5, wherein an underground layer is provided below a polishing layer comprising the polishing surface.

7. The polishing pad as claimed in any of claims 1 and 2, wherein an underground layer is provided below a polishing layer comprising the polishing surface.

8. The polishing pad as claimed in claim 1, wherein the largest amplitude is 10-40 μm.

9. The polishing pad as claimed in claim 1, wherein the largest amplitude is a value measured in a distance range of 5-200 mm along the polishing surface.

* * * * *